US007464565B2

(12) United States Patent
Fu

(10) Patent No.: US 7,464,565 B2
(45) Date of Patent: Dec. 16, 2008

(54) RAPID TEMPERATURE CHANGE DEVICE FOR A REFRIGERATOR

(75) Inventor: Xiaoyong Fu, Plano, TX (US)

(73) Assignee: Maytag Corporation, Benton Harbor, MI (US)

( * ) Notice: Subject to any disclaimer, the term of this patent is extended or adjusted under 35 U.S.C. 154(b) by 282 days.

(21) Appl. No.: 11/288,237

(22) Filed: Nov. 29, 2005

(65) Prior Publication Data

US 2007/0119201 A1 May 31, 2007

(51) Int. Cl.
*F25D 17/06* (2006.01)

(52) U.S. Cl. ..... 62/419; 62/340

(58) Field of Classification Search ..... 62/3.6, 62/347–353, 497–419
See application file for complete search history.

(56) References Cited

U.S. PATENT DOCUMENTS

| | | | | |
|---|---|---|---|---|
| 3,226,939 | A | 1/1966 | Harbison et al. | |
| 3,788,089 | A | 1/1974 | Graves | |
| 3,828,568 | A | 8/1974 | Frazier | |
| 3,850,008 | A | 11/1974 | Frazier | |
| 4,358,932 | A | 11/1982 | Helfrich, Jr. | |
| 4,368,622 | A | 1/1983 | Brooks | |
| 4,474,023 | A | 10/1984 | Mullins, Jr. | |
| 4,852,359 | A * | 8/1989 | Manzotti | 62/68 |
| 5,207,762 | A | 5/1993 | Newman | |
| 5,620,997 | A | 4/1997 | Bolton et al. | |
| 5,709,104 | A * | 1/1998 | Howcroft | 62/457.1 |
| 5,899,089 | A | 5/1999 | Kwon | |
| 5,930,454 | A | 7/1999 | Cho | |
| 6,422,031 | B1 | 7/2002 | Mandel et al. | |
| 6,438,988 | B1 | 8/2002 | Paskey | |
| 6,463,752 | B2 | 10/2002 | Mandel et al. | |
| 6,474,094 | B2 | 11/2002 | Kim | |
| 6,612,116 | B2 * | 9/2003 | Fu et al. | 62/3.6 |
| 6,732,537 | B1 | 5/2004 | Anell et al. | |
| 6,735,959 | B1 | 5/2004 | Najewicz | |
| 7,266,973 | B2 * | 9/2007 | Anderson et al. | 62/351 |
| 7,284,390 | B2 | 10/2007 | Van Meter et al. | |

(Continued)

FOREIGN PATENT DOCUMENTS

EP 0 109 225 B1 2/1985

(Continued)

OTHER PUBLICATIONS

Bocan, Thomas, M. A., et al, "A specific 15-lipoxygenase inhibitor limits the progression and monocyte-macrophage enrichment of hypercholesterolemia-induced atherosclerosis in the rabbit", *Atherosclerosis*, vol. 136, No. 2, 1998, pp. 203-216.

*Primary Examiner*—William E Tapolcai
(74) *Attorney, Agent, or Firm*—Kirk Goodwin; Michael D. LaFrenz

(57) ABSTRACT

A quick-cooling device for a refrigerator includes top, bottom and opposing side walls that collectively define an air intake/delivery housing. A plurality of air discharge nozzles are arranged about at least one wall of the housing. A blower fan is mounted to the housing for drawing an airflow from the refrigerator into the housing and thereafter expelling the airflow from the housing through the air discharge nozzles. The air discharge nozzles can be constituted by slotted or circular openings arranged in staggered rows and sized to match a particular application.

17 Claims, 5 Drawing Sheets

U.S. PATENT DOCUMENTS

| | | | |
|---|---|---|---|
| 7,337,620 | B2 | 3/2008 | Coulter et al. |

FOREIGN PATENT DOCUMENTS

| | | |
|---|---|---|
| EP | 1 517 103 | 3/2005 |
| GB | 2167544 | 5/1986 |
| JP | 05-106958 | 4/1993 |
| JP | 06-011231 | 1/1994 |
| WO | WO 97/12613 | 4/1997 |
| WO | WO 99/32433 | 7/1999 |

* cited by examiner

RAPID TEMPERATURE CHANGE DEVICE FOR A REFRIGERATOR

BACKGROUND OF THE INVENTION

1. Field of the Invention

The present invention pertains to the art of refrigerators and, more particularly, to a device for rapidly altering a temperature of an item in a refrigerator.

2. Discussion of the Prior Art

In the art of refrigerated appliances, it is known to employ a device to rapidly alter a temperature of a selected food item. The device can be used to decrease ice production time, rapidly chill a beverage, thaw a frozen food item or perform other similar operations. In general, the device can be mounted over an icemaker in a freezer to decrease ice production time or positioned in a fresh food compartment for chilling beverages or thawing frozen foods. Some appliances include through-the-door quick-coolers that enable a consumer to quickly chill, for example, a beverage container without opening the appliance. Regardless of the particular configuration, the devices are large, bulky mechanisms that take up precious space in the appliance. In the highly competitive field of home appliances, storage space in a refrigerator is a major design consideration and, often, a key selling point.

Based on the above, despite the presence of various devices that bring about a rapid temperature change for items in a refrigerator, there still exists a need for a quick-cooling device for a refrigerator. More specifically, there exists a need for a quick-cooling device that is compact in size, easily re-positionable and, when positioned below a food item, causes a rapid change in temperature by disrupting a thermal insulation layer allowing faster temperature transfer.

SUMMARY OF THE INVENTION

The present invention is directed to a rapid temperature change or quick-cooling device for rapidly altering a temperature of an article in a refrigerator. Preferably, the quick-cooling device includes top, bottom and opposing side walls that collectively define an air intake/delivery housing, a plurality of air discharge nozzles arranged about at least one wall of the housing and a blower fan for drawing an airflow in from the refrigerator into the housing and expelling the airflow from the housing through the air discharge nozzles and back into the refrigerator. The quick-cooling device includes a power supply adapted to deliver power in a range of between approximately 3-5 watts to the blower fan. The power supply can produce AC or DC power depending upon particular application requirements.

In accordance with one aspect of the invention, each of the plurality of discharge nozzles is constituted by a slotted opening formed in one wall of the housing. Preferably, the slotted opening has an area of between approximately 0.03 and 0.049 square inches (about 0.19 and 0.316 square cm). Alternatively, each of the plurality of discharge nozzles could be constituted by a generally circular opening having a diameter of between approximately 0.2 and 0.25 inches (about 0.51 and 0.64 cm). Regardless of the particular configuration, the plurality of nozzles direct an airflow onto an outer surface of an article in the refrigerator to disrupt a thermal barrier and bring about a rapid temperature change. In the case of ice production, employing the device has been found to establish a rapid temperature change that can speed ice formation by as much as 2-3 times.

In any event, the plurality of discharge nozzles are formed into rows that extend longitudinally across the wall of the housing. The rows are preferably arranged so that a spacing of approximately 1.5 inches (about 3.81 cm) is maintained between each of the plurality of discharge nozzles. In the most preferred form of the invention, the plurality of rows are staggered so that adjacent nozzles are not arranged in adjacent rows.

Additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF THE PREFERRED EMBODIMENTS

Figure 1:
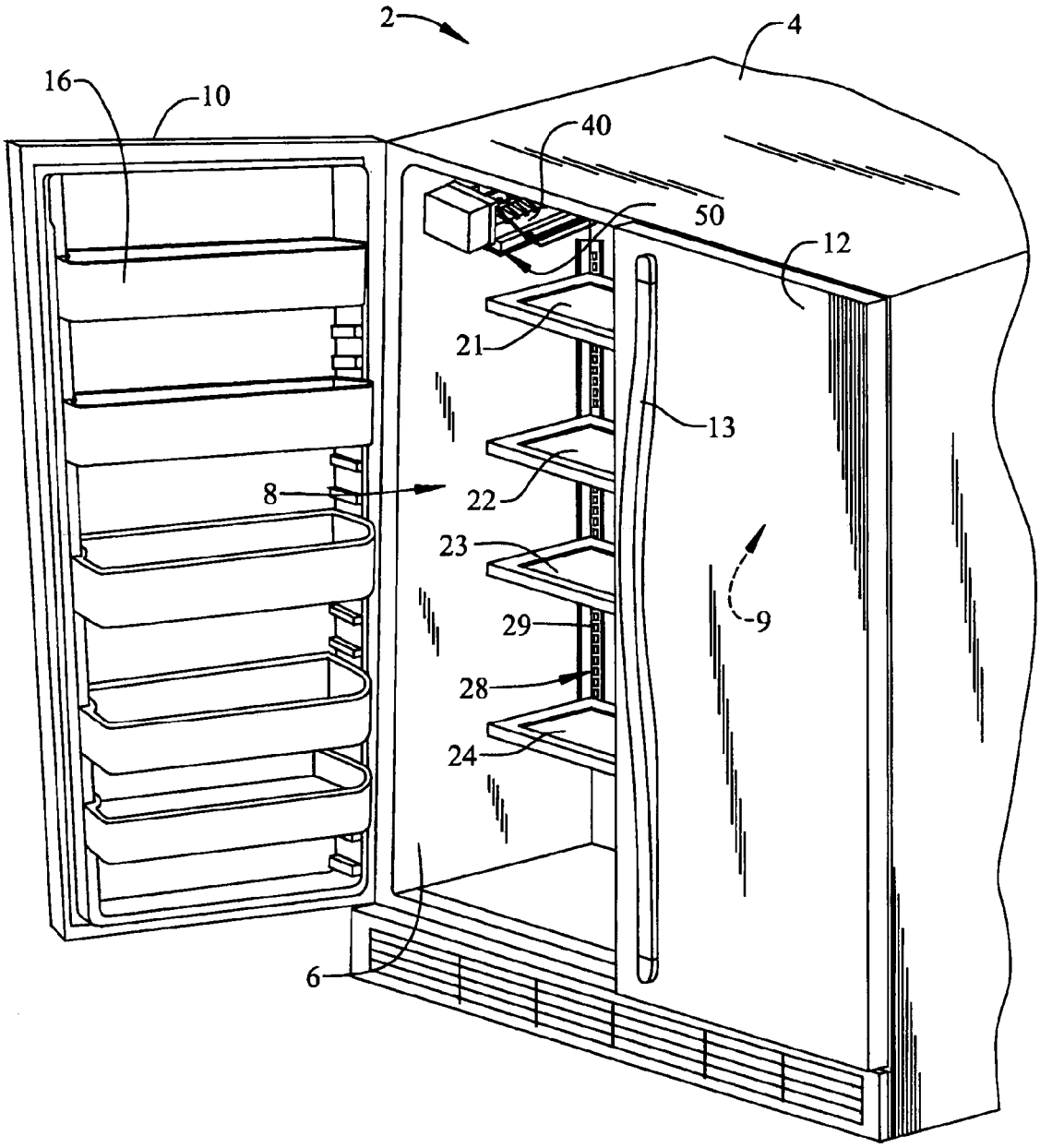
FIG. 1 is a partial, upper right perspective view of a side-by-side refrigerator incorporating a quick-cooling device constructed in accordance with the present invention, with the quick cooling device depicted in a quick-ice configuration.

With initial reference to FIG. 1, a refrigerator generally indicated at 2 includes an outer shell or cabinet 4 within which is positioned a liner 6. In the embodiment shown, liner 6 defines a freezer compartment 8. In a similar manner, a fresh food compartment 9 is established in cabinet 4. In a manner known in the art, freezer compartment 8 can be accessed by the selective opening of a freezer door 10. In a similar manner, a fresh food door 12 can be opened by engaging handle 13 to access fresh food compartment 9. For the sake of completeness, refrigerator 2 is shown to include, on freezer door 10, a plurality of vertically adjustable shelving units, one of which is indicated at 16. Further illustrated for exemplary purposes are a plurality of shelves 21-24 arranged in freezer compartment 8 that are cantilevered from spaced shelf ladders, one of which is indicated at 28, having a plurality of vertically spaced apertures 29.

Positioned in freezer compartment 8, above shelf 21, is an automatic icemaker 40 which, in a manner known in the art, produces and dispenses ice into a hopper or bin (not shown). Positioned below icemaker 40 is a quick-cooling device 50 constructed in accordance with the present invention. In accordance with this embodiment of the invention, quick-cooling device 50 functions to direct an air flow onto a lower portion of icemaker 40 to speed ice production time. That is, when positioned below icemaker 40, quick-cooling device 50 will decrease an amount of time required to produce ice as will be discussed more fully below.

Figure 2:
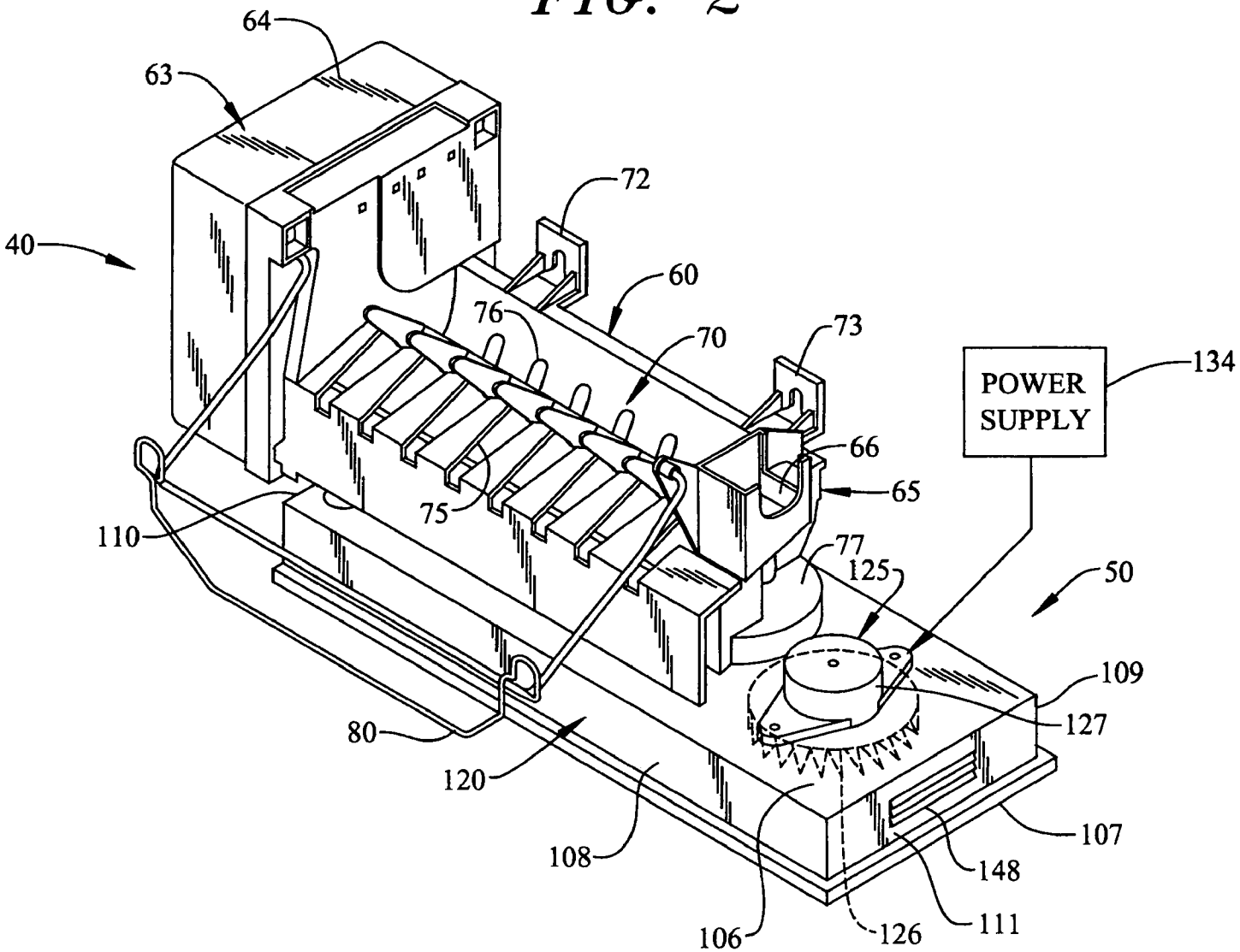
FIG. 2 is an upper right perspective view of the quick-cooling device arranged below an icemaker.

Referring to FIG. 2, icemaker 40 includes a main body portion 60 having a first end 63 defining a motor housing 64.

First end 63 extends to a second end 65, at which is arranged a water inlet 66. Arranged between first end 63 and second end 65 is an ice dispensing portion 70. As shown, ice dispensing portion 70 is provided with a pair of mounting brackets 72 and 73 that are adapted to secure icemaker 40 to, for example, a side wall (not separately labeled) of freezer compartment 8. Ice dispensing portion 70 includes a plurality of outlet openings, one of which is indicated at 75, through which formed ice cubes pass. The formed ice cubes are designed to fall into a bucket or hopper (not shown) positioned below icemaker 40. In a manner known in the art, the ice cubes are guided through the plurality of outlet openings 75 by a plurality of push or lifting members, one of which is indicated at 76, that raise the ice cubes from an ice tray 77, through outlet openings 75. Icemaker 40 is also provided with a bail arm 80 which is adapted to selectively halt ice production when additional ice is not required. In general, this description of exemplary icemaker 40 is known in the art and provided only for the sake of completeness.

Figure 3:
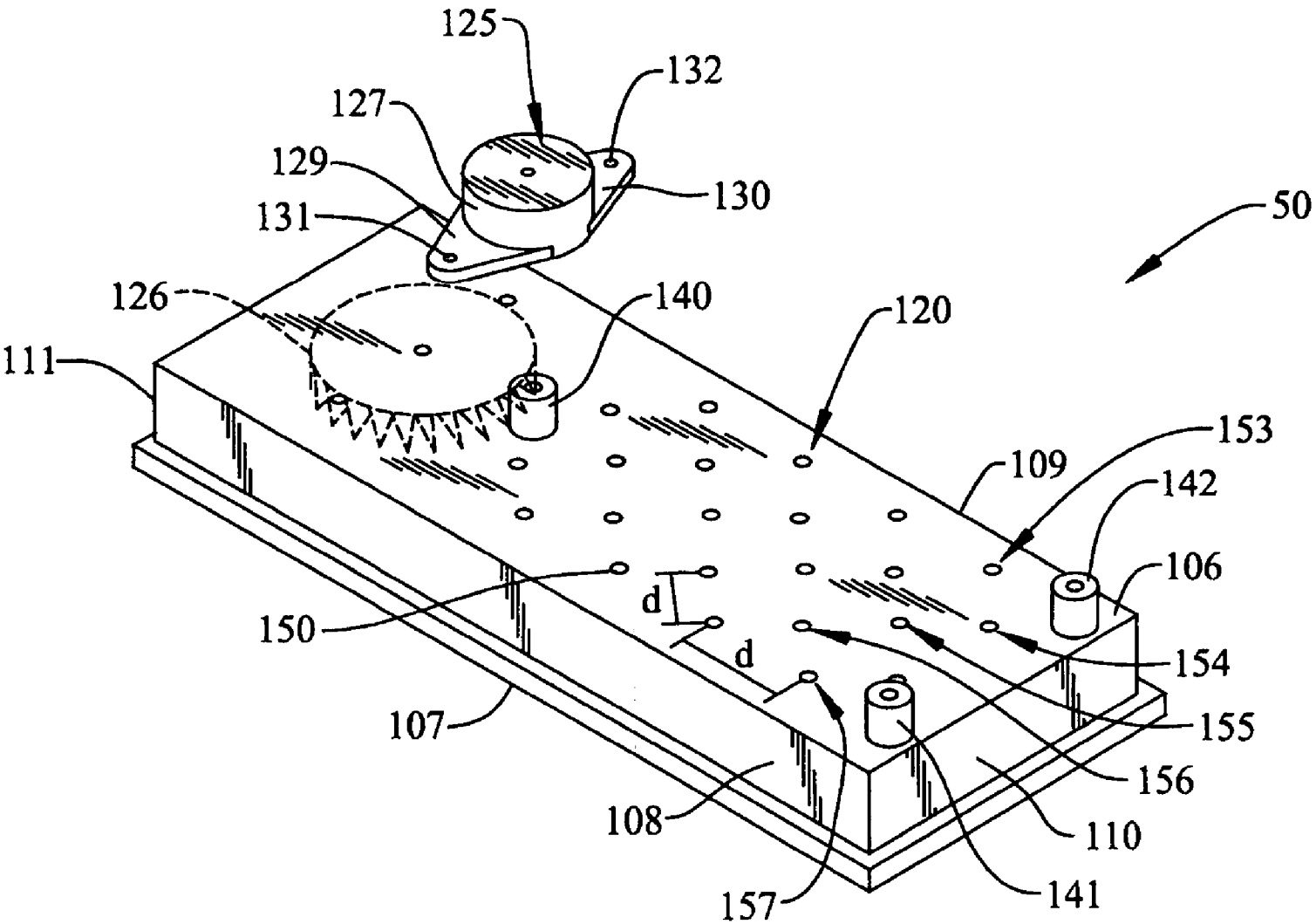
FIG. 3 is an upper right, partially exploded, perspective view of the quick-cooling device constructed in accordance with a first embodiment of the present invention.

Reference will now be made to FIGS. 2 and 3 in describing quick-cooling device 50 constructed in accordance with a first embodiment of the present invention. In the embodiment shown, quick-cooling device 50 includes top, bottom and opposing side wall portions 106-111 that collectively define an intake/discharge housing 120. A blower motor 125 is mounted to top wall 106 of intake/discharge housing 120. Blower motor 125 is drivingly connected to a fan wheel 126 and includes a main housing 127 from which projects a drive shaft (not shown). Blower motor 125 is also provided with a pair of mounting flanges 129 and 130 that extend radially outward from main housing 127. Each mounting flange 129, 130 is provided with a respective mounting aperture 131, 132 for securing blower motor 125 to top wall 106 with, for example, a respective mechanical fastener (not shown). Blower motor 125 is operatively connected to a power supply 134 (FIG. 2) that supplies either AC or DC current (depending on the particular configuration) to drive fan wheel 126.

In the most preferred form of the invention, power supply 134 delivers between approximately 3 and 5 watts of power to blower motor 125. A low wattage output is particularly advantageous in cooling applications, as the radiation of heat generated by the operation of blower motor 125 is maintained at a very low level. Thus, maintaining power input to between approximately 3-5 watts minimizes any heat generation that could adversely affect the overall cooling effect of quick-cooling device 50. As further illustrated in FIG. 3, quick-cooling device 50 is provided with a plurality of mounting lugs 140-142 arranged about top wall 106. In accordance with the embodiment shown, mounting lugs 140-142 serve as attachment points for securing quick-cooling device 50 to an underside of icemaker 40 or, as will be detailed more fully below, to other portions of refrigerator 2. In addition to providing structure for securing quick-cooling device 50, mounting lugs 140-142 establish a preferred spacing between quick-cooling device 50 and an underside (not separately labeled) of ice tray 77. For most efficient operation, quick-cooling device 50 is preferably spaced approximately 0.5 and 1 inch (about 1.27 and 2.54 cm) from ice tray 77.

In further accordance with the embodiment illustrated in FIG. 3, side wall 111 includes an inlet opening 148 while top wall 106 is formed with a plurality of discharge nozzles, one of which is indicated at 150. In accordance with one aspect of the invention, discharge nozzles 150 are constituted by generally circular openings arranged in a plurality of rows 153-157 that extend longitudinally along top wall 106. Preferably, each discharge nozzle 150 has a diameter of between approximately 0.2 and 0.25 inches (about 0.51 and 0.64 cm) and are maintained in a spaced relationship such that a distance (d) between adjacent nozzles 150 in respective rows 153-157 is approximately 1.5 inches (about 3.81 cm). Most preferably, nozzles 150 in adjacent rows 153-157 are staggered one from the other so, for example, discharge nozzles 150 in row 157 are not positioned directly adjacent or aligned laterally with discharge nozzles 150 located in adjacent row 156.

The overall size and spacing of discharge nozzles 150 is designed to optimally correspond to ice tray 77 of icemaker 40 so as to obtain the greatest possible heat transfer coefficient. Discharge nozzles 150 are arranged about top wall 106 such that cool air emanates from nozzles 150 to disrupt an insulation layer that develops on an underside of ice tray 77. However, it is desired to shield the plurality of outlet openings 75 arranged closest to second end 75 of icemaker 40 from direct air in order to avoid hollow ice cube production. In accordance with a preferred form of the invention, the two outlet openings 75 that are shielded are adjacent a thermostat (not shown) positioned in motor housing 64. More specifically, given that direct air in this area could negatively impact the overall ice production of icemaker 40, there are no nozzles 150 positioned below the closest of the plurality of outlet openings 75 arranged adjacent motor housing 64, e.g., the first two outlet openings 75. In any event, in response to a signal received from a central control (not shown), blower motor 125 operates fan wheel 126 to draw cool air from freezer compartment 8 into housing 120 through inlet opening 148. The cool air is then discharged through nozzles 150 onto an underside of ice tray 77. It has been found that this direct impingement of cool air onto the underside of ice tray 77 speeds ice production by as much as 2-3 times the normal rate of production.

Figure 4:
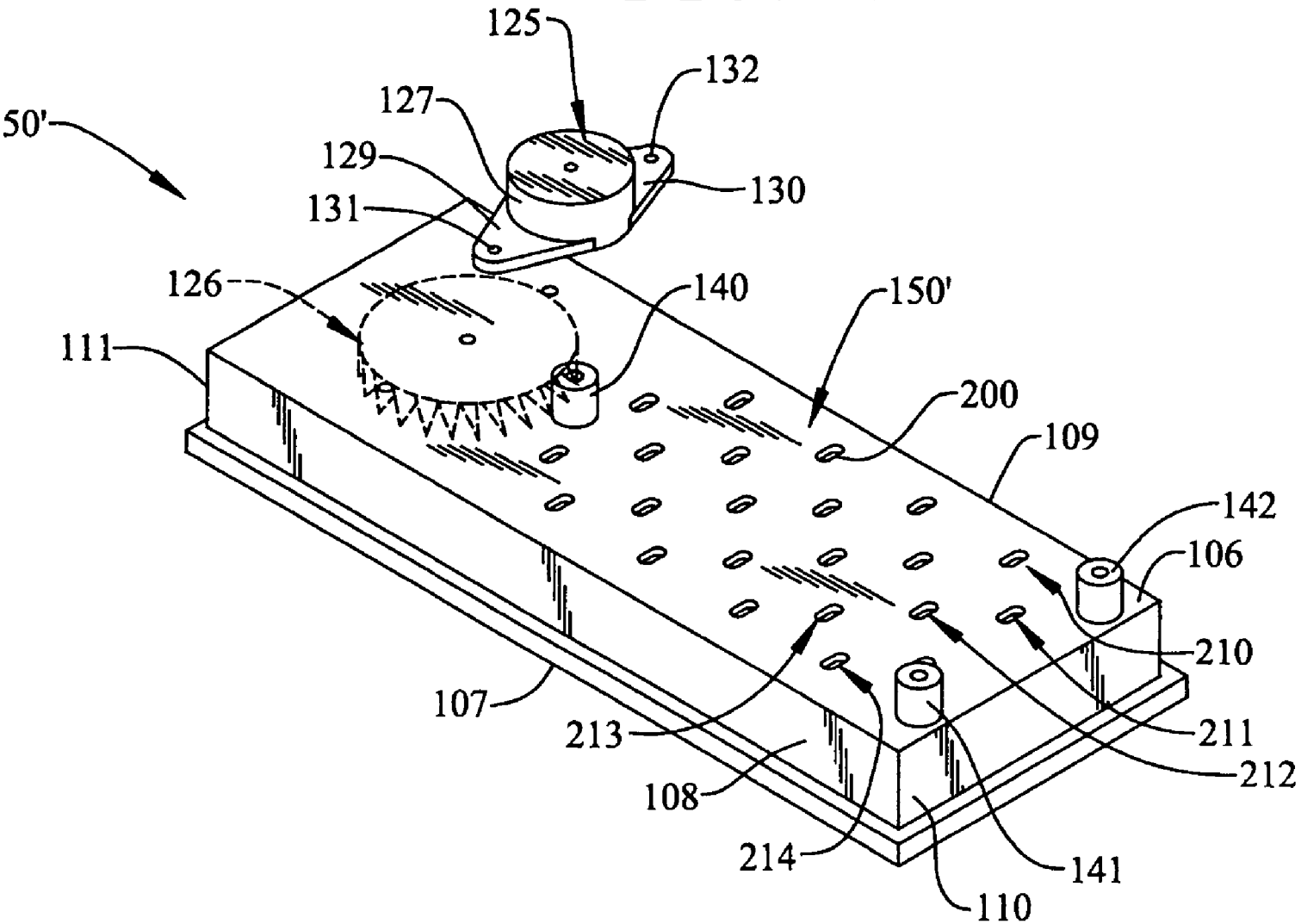
FIG. 4 is an upper right, partially exploded, perspective view of the quick-cooling device constructed in accordance with a second embodiment of the present invention.

Reference will now be made to FIG. 4 in describing a quick-cooling device 50' constructed in accordance with a second embodiment of the present invention. As shown, quick-cooling device 50' is provided with a plurality of discharge nozzles 150' shown in the form of slotted openings 200. Slotted openings 200 are formed to have an overall area of between approximately 0.03 and 0.049 square inches (about 0.19 and 0.32 square cm). In a manner analogous to that described above, slotted openings 200 are arranged in a plurality of rows 210-214 such that, upon activation, a cooling air flow is expelled through openings 200 onto a lower surface of ice tray 77. In a manner corresponding to the embodiment described above, the operation of quick-cooling device 50' speeds the production of ice up to as much as 2-3 times. Therefore, when large amounts of ice are needed with either device 50 or 50' present, a consumer need simply select a quick ice option button, switch or the like provided on a control portion (not shown) of refrigerator 2 to activate quick-cooling device 50 or 50'.

Figure 5:
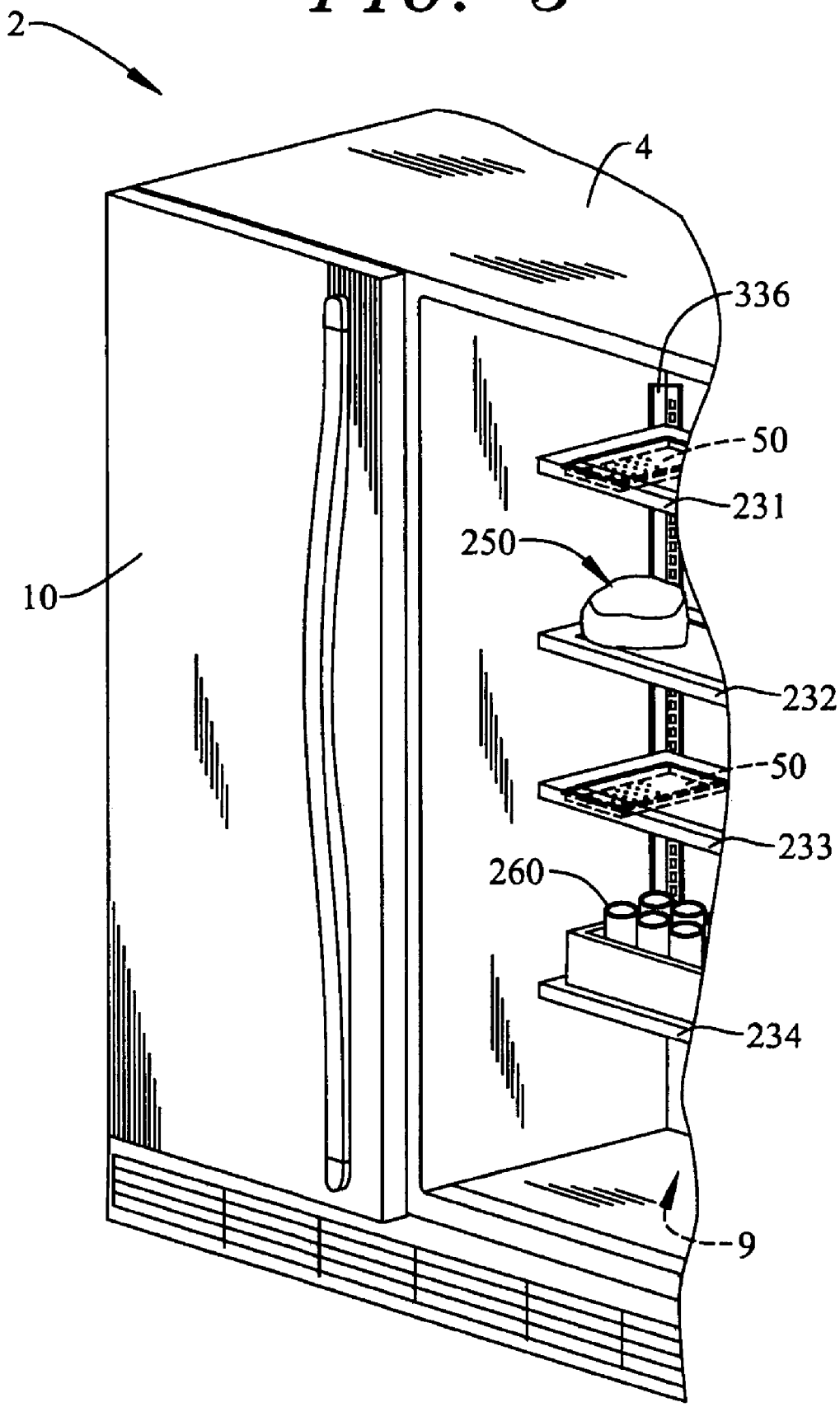
FIG. 5 is a partial, upper right perspective view of the side-by-side refrigerator of FIG. 1 illustrating two quick-cooling devices positioned in a fresh food compartment, with one of the quick-cooling devices performing a thawing operation and another of the quick-cooling devices performing a beverage cooling operation.

While quick cooling device 50, 50' is described as being mounted below ice tray 77, other locations within refrigerator 2 could equally benefit from quick-cooling. For example, FIG. 5 illustrates an alternative positioning of quick cooling device 50. As shown, quick-cooling device 50 is placed in fresh food compartment 9 on an underside of one of a plurality of shelves 231-234 cantilevered from spaced shelf ladders, one of which is indicated at 336. In this arrangement, quick cooling device 50 is attached to the underside of one of the plurality of shelves 231-234 with suitable attachment members (not shown), preferably without mounting lugs 140-142 as there is no need to maintain or establish a requisite spacing in this configuration. The air discharged from nozzles 150 are directed downward to thaw frozen food items such as indicated at 250 or, alternatively, to cool beverages such as shown at 260. Of course, quick cooling device 50 could also simply be placed upon one of the plurality of shelves 231-234 or mounted to a dedicated support structure (not shown). In any case, although described with reference to preferred embodiments of the present invention, it should be readily apparent to one of ordinary skill in the art that various changes and/or modifications can be made to the invention without departing from the spirit thereof. In general, the invention is only intended to be limited to the scope of the following claims.

I claim:

1. A refrigerator comprising:

a cabinet within which is defined at least one of fresh food and freezer compartments;

at least one door for selectively closing the one of the fresh food and freezer compartments;

a plurality of shelves arranged within the at least one of the fresh food and freezer compartments; and a quick-cooling device for rapidly changing a temperature of a selected item in the cabinet, said quick-cooling device including top, bottom and opposing side walls that collectively define an air intake/delivery housing, a plurality of air discharge nozzles arranged about the bottom wall of the housing, and a blower fan connected to the housing adjacent the plurality of air discharge nozzles for drawing an airflow from the at least one of the fresh food and freezer compartments into the housing and thereafter expelling the airflow from the housing through the plurality of air discharge nozzles with said airflow being directed onto a selected item to bring about a rapid change in temperature of the selected item, wherein the quick-cooling device is mounted beneath one of the plurality of shelves for thawing or cooling products below the one of the plurality of shelves.

2. The refrigerator according to claim 1, further comprising: a power supply adapted to deliver power in a range of approximately 3-5 watts to the blower fan.

3. The refrigerator according to claim 2, wherein the power supply outputs AC power to the blower fan.

4. The refrigerator according to claim 1, wherein each of the plurality of discharge nozzles is constituted by a slotted opening having a predetermined area.

5. The refrigerator according to claim 4, wherein the predetermined area of each slotted opening is between approximately 0.03 and 0.049 square inches (about 0.19 and 0.32 square cm).

6. The refrigerator according to claim 1, wherein each of the plurality of discharge nozzles is constituted by a generally circular opening having a predetermined diameter.

7. The refrigerator according to claim 6, wherein the predetermined diameter of the generally circular opening is between approximately 0.2 and 0.25 inches (about 0.5 and 0.6 cm).

8. The refrigerator according to claim 1, wherein adjacent ones of the plurality of discharge nozzles are spaced a distance of approximately 1.5 inches (about 3.8 cm).

9. The refrigerator according to claim 1, wherein the plurality of discharge nozzles are formed into a plurality of rows extending longitudinally across the bottom wall of the housing.

10. The refrigerator according to claim 9, wherein the plurality of discharge nozzles in adjacent ones of the plurality of rows are staggered.

11. A quick-cooling device for rapidly changing a temperature of a selected item in a refrigerator having a plurality of shelves comprising:

top, bottom and opposing side walls that collectively define an air intake/delivery housing;

a plurality of air discharge nozzles arranged about the bottom wall of the housing; and a blower fan connected to the housing adjacent the plurality of air discharge nozzles for drawing an airflow from at least one of fresh food and freezer compartments of the refrigerator into the housing and thereafter expelling the airflow from the housing through the plurality of air discharge nozzles with said airflow being directed onto a selected item to bring about a rapid change in temperature of the selected item, wherein the quick-cooling device is adapted to be mounted beneath one of the plurality of shelves for thawing or cooling products below the one of the plurality of shelves.

12. The quick-cooling device according to claim 11, wherein each of the plurality of discharge nozzles is constituted by a slotted opening having a predetermined area.

13. The quick-cooling device according to claim 12, wherein the predetermined area of each slotted opening is between approximately 0.03 and 0.049 square inches (about 0.10 and 0.32 square centimeters).

14. The quick-cooling device according to claim 11, wherein each of the plurality of discharge nozzles is constituted by a generally circular opening having a predetermined diameter.

15. The quick-cooling device according to claim 14, wherein the predetermined diameter of the generally circular opening is between approximately 0.2 and 0.25 inches (about 0.5 and 0.6 cm).

16. The quick-cooling device according to claim 11, wherein adjacent ones of the plurality of discharge nozzles are spaced a distance of approximately 1.5 inches (about 3.8 cm).

17. The quick-cooling device according to claim 11, wherein the plurality of discharge nozzles are arranged in rows, with the plurality of discharge nozzles in adjacent rows being staggered.

* * * * *